US005772124A

United States Patent [19]

Tamaki et al.

[11] Patent Number: 5,772,124

[45] Date of Patent: Jun. 30, 1998

[54] FUEL INJECTION VALVE

[75] Inventors: Yoshiyuki Tamaki; Keiso Takeda, both of Mishima; Nobuhiko Koga, Susono, all of Japan

[73] Assignee: Toyota Jidosha Kabushiki Kaisha, Toyota, Japan

[21] Appl. No.: 678,673

[22] Filed: Jul. 11, 1996

[30] Foreign Application Priority Data

Jul. 24, 1995 [JP] Japan ..... 7-187401

[51] Int. Cl.[6] ..... F02M 61/00

[52] U.S. Cl. ..... 239/533.12

[58] Field of Search ..... 239/585.1–585.5, 239/900, 533.3–533.12

[56] References Cited

U.S. PATENT DOCUMENTS

| | | | |
|---|---|---|---|
| 4,057,190 | 11/1977 | Kiwior et al. | 239/533.12 X |
| 4,423,842 | 1/1984 | Palma | 239/900 X |
| 4,646,974 | 3/1987 | Sofianek et al. | 239/533.12 X |
| 4,890,794 | 1/1990 | Imafuku et al. | 239/533.12 |
| 4,934,605 | 6/1990 | Hans et al. | 239/585.4 |
| 5,383,607 | 1/1995 | Heyse et al. . | |
| 5,662,277 | 9/1997 | Taubitz et al. | 239/533.12 X |

FOREIGN PATENT DOCUMENTS

| | | |
|---|---|---|
| 28-43-000-A1 | 10/1978 | Germany . |
| U-3-92564 | 9/1991 | Japan . |
| U-3-104166 | 10/1991 | Japan . |
| A-7-78920 | 3/1995 | Japan . |

*Primary Examiner*—Kevin Weldon
*Attorney, Agent, or Firm*—Oliff & Berridge, PLC

[57] ABSTRACT

A fuel injection valve with improved fuel atomization which has a valve body, a needle valve accommodated in the valve body for opening and closing a fuel path at a sealing portion, and a metering member provided at a front end of the valve body and having a plurality of nozzle holes for metering a fuel and determining the fuel-injecting direction. The fuel injection valve comprises an inner wall of the valve body located downstream of the sealing portion which is shaped to be gradually contiguous to an upstream side surface of the metering member, and an intermediate surface of the needle valve for connecting the sealing portion and the most-downstream side bottom surface of the needle valve with each other forming the fuel path sloped inward in the downstream direction in association with the inner wall for introducing the fuel into the nozzle holes formed in the metering member when the needle valve is in an open state, wherein the intermediate surface of the needle valve being shaped in such a manner that a virtual intersecting line of a virtual linear extension of the intermediate surface and the upstream side surface of the metering member is positioned outside of a virtual circle circumscribing the upstream side openings of the nozzle holes formed in the metering member when the needle valve is in an open state.

3 Claims, 3 Drawing Sheets

FUEL INJECTION VALVE

BACKGROUND OF THE INVENTION

1. Field of the Invention

The present invention relates to a fuel injection valve, particularly to a fuel injection valve having a metering member with nozzle holes at a front end of a valve body for fuel metering and determining the fuel-injection direction, and for ejecting fuel therethrough.

2. Description of the Related Art

These has been known a fuel injection valve having a metering member with nozzle holes at the front end of a valve body for fuel metering and determining fuel-injection direction, and for ejecting fuel therethrough (Japanese Unexamined Utility Model Publications No. 3-92564 and No. 3-104166).

The fuel injection valve disclosed in the above publications is adapted so that fuel passing a sealing portion of a needle valve for opening and closing a fuel path is directly guided to nozzle holes. Although the reduction of the kinetic energy in the fuel is suppressed in this prior art valve, there is a problem in that the fuel enters a combustion chamber in a non-atomized state while remaining in a liquid column or film shape.

To solve this problem, the assignee of the present invention proposed a fuel injection valve, in Japanese Patent Application No. 7-078920, which has a projection at a front end of the needle valve projecting into a fuel injection path so that a virtual extension of the outer periphery of the projection is positioned outside of virtual circle circumscribing upstream side opening of the nozzle holes in the metering member so that the fuel passing the sealing portion first flows toward the metering member and, after impinging upon the metering member, toward a center along the metering member whereby the fuel is easily peeled off from the entrance opening of the nozzle holes and the fuel column or fuel film is well self-excitingly vibrated to obtain well-atomized fuel.

However, there is a problem in that the kinetic energy of the fuel largely decreases and thereby the fuel is not well peeled off from the entrance opening of the jet and not effectively atomized in the fuel injection valve proposed in the above Patent Application, since the fuel in which a vertical flow component is stronger is suddenly deflected in the lateral direction when passing the sealing portion.

SUMMARY OF THE INVENTION

An object of the present invention is to solve the above problem in a fuel injection valve having a metering member with nozzle holes at a front end of a valve body by suppressing the decrease of kinetic energy in the fuel so that the fuel is well peeled off at the entrance opening of the nozzle holes and provides a good atomization of the fuel.

To achieve the above object, according to the present invention, the invention provides a fuel injection valve having a valve body, a needle valve accommodated in the valve body for opening and closing a fuel path at a sealing portion, and a metering member provided at a front end of the valve body and having a plurality of nozzle holes for metering fuel and determining the fuel-injecting direction, which comprises an inner wall of the valve body located downstream of the sealing portion being shaped to be gradually contiguous to an upstream side surface of the metering member, and an intermediate surface of the needle valve for connecting the sealing portion and the most-downstream side bottom surface of the needle valve with each other and forming the fuel path sloped inward in the downstream direction in association with the inner wall for introducing the fuel into the nozzle holes formed in the metering member when the needle valve is in an open state, wherein the intermediate surface of the needle valve being shaped in such a manner that a virtual intersecting line of a virtual linear extension of the intermediate surface and the upstream side surface of the metering member is positioned outside of a virtual circle circumscribing the upstream side openings of the nozzle holes formed in the metering member when the needle valve is in an open state.

The present invention will be more fully understood from the description of the preferred embodiments of the invention as set forth below, together with the accompanying drawings.

DESCRIPTION OF THE PREFERRED EMBODIMENTS

Figure 1:
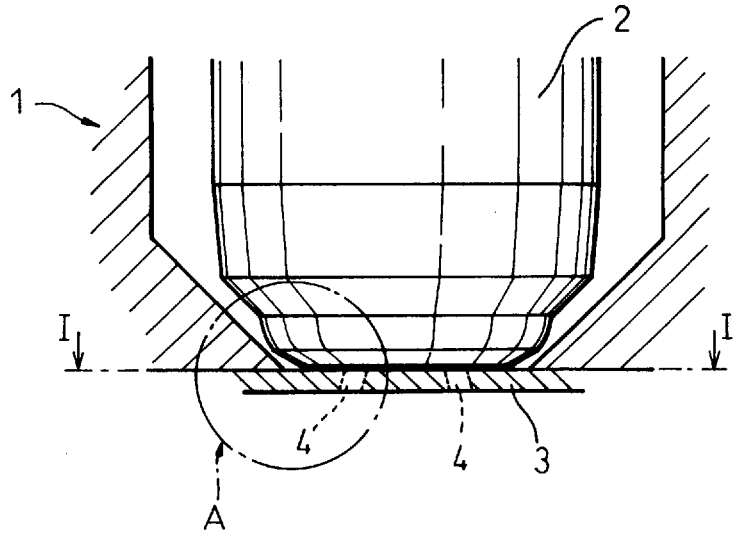
FIG. 1 is a schematic view of a first embodiment of the present invention.

FIG. 1 is a side sectional view of a first embodiment of a fuel injection valve according to the present invention, wherein a needle valve 2 is accommodated in the interior of a valve body 1, and a metering member 3 is mounted to a front end of the valve body 1. The metering member 3 has a plurality of nozzle holes 4.

Figure 2:
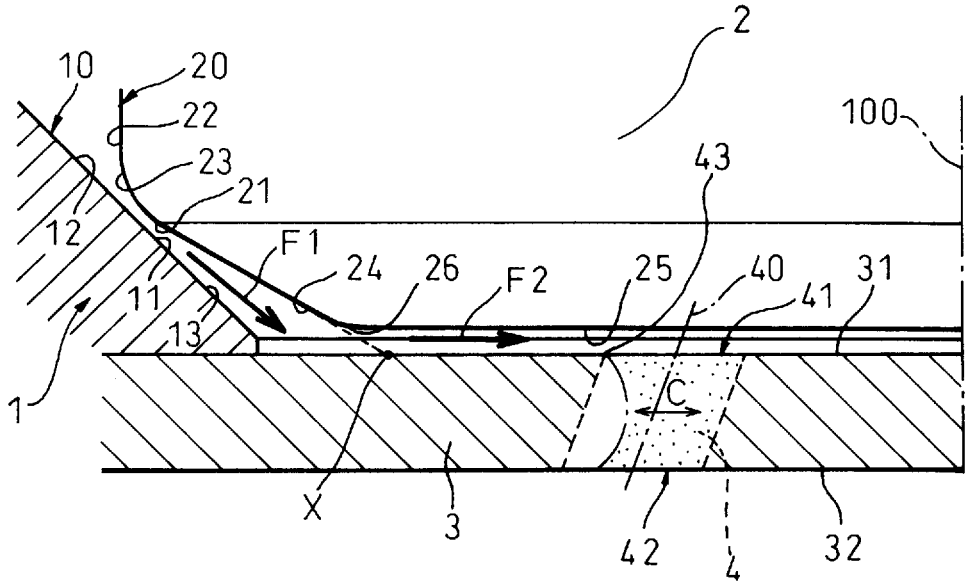
FIG. 2 is an enlarged view of part A in FIG. 1.

FIG. 2 is an enlarged view of part A in FIG. 1, illustrating a state when a fuel is injected.

In FIG. 2, reference numeral 10 denotes a whole inner wall of the valve body 1, and 20 denotes a whole outer wall of the needle valve. Reference numerals 11 and 21 respectively denote sealing portions of the valve body 1 and the needle valve 2, respectively, which are brought into contact with each other to shut off the flow of fuel when no fuel injection is required.

The inner wall 10 of the valve body 1 straightly extends from a portion 12 upstream from the sealing portion 11 to a portion 13 downstream from the sealing portion 11 so that the inner wall 10 approaches a center axis 100 of the fuel injection valve as extending in the downstream direction. In this regard, there is shown a portion extending parallel to the center axis 100 between the valve body 1 and the metering member 4. The above portion is formed when the valve body is machined.

The outer wall 20 of the needle valve 2 extends from a portion 22 which is substantially parallel to the center axis 100 to the sealing portion 21 through a curved portion 23 in an upstream side of the sealing portion 21, and extends to a bottom surface 25 through a linear portion 24 forming an intermediate conical surface in a downstream side of the sealing portion 21. The linear portion 24 and the bottom surface 25 are smoothly connected to each other via a curved portion 26. The bottom surface 25 is oriented perpendicular to the center axis 100.

Upper and lower surfaces 31 and 32, respectively, of the metering member 3 are oriented perpendicular to the center axis 100. Accordingly, the upper surface 31 of the metering member 3 is parallel to the bottom surface 25 of the needle valve 2.

Each of the nozzle holes 4 is oriented so that virtually in the upstream direction, extended center axies 40 thereof intersect the center axis 100, and entrance openings 41 of the nozzle holes are located on the inner side as opposed to exit openings 42 thereof.

In this regard, a point X which is below defined is positioned on the outer side of the outermost edge 43 of the entrance opening 41 of the nozzle holes 4 in the metering member 3.

The point X is defined as a virtual intersecting point of a virtual generating line extending from a point on a linear portion 24, which is positioned downstream of the sealing portion 21 in the outer wall 20 of the needle valve 2, to a virtual vertex of the conical surface on the center axis, and the upper surface 31 of the metering member.

Figure 3:
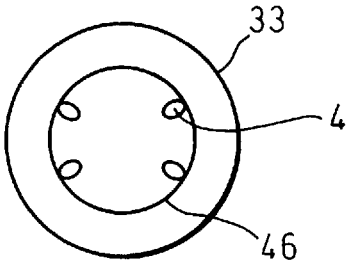
FIG. 3 is a cross-section taken along line I—I in FIG. 1.

FIG. 3 is a cross-section taken along line I—I of FIG. 1, wherein reference numeral 33 denotes virtual circle depicted by the above defined point X, and 46 denotes a virtual circle circumscribing the outermost edges 43 of the entrance openings 41 of the nozzle holes 4.

The flow of fuel in the above embodiment of the present invention will be described below.

During the needle valve open state, the fuel flows through a gap between the sealing portion 11 of the valve body 1 and the sealing portion 21 of the needle valve 2, and then through a fuel path sloped inward in the downstream direction, formed between the downstream portion 13 of the valve body 1 and the downstream linear portion 24 of the needle valve 2 as shown by an arrow F1 in FIG. 2.

After impinging upon the upper surface 31 of the metering member 3, the fuel flows in the arrowed direction F2 through a fuel path formed between the upper surface 31 of the metering member 3 and the bottom surface 25 of the needle valve 2 toward the center axis 100.

Thereafter, the fuel enters the nozzle holes 4 from the entrance opening 41 and is discharged from the exit opening 42 while forming a fuel column or film. However, since the fuel column or film is peeled off at the entrance opening 41 when the same enters the nozzle holes 4, a periodic vortex occurs in part of the fuel stream when the fuel enters the nozzle holes. As a result, the width of the fuel stream passing through the nozzle holes 4 varies in the arrowed direction C, causing a self-exciting vibration in the fuel column or film which then is atomized to fine particles.

As described above, according to the present invention, the fuel initially flows in the arrowed direction F1 in an area downstream from the sealing portion, and then is deflected in the arrowed direction F2. Since the deflecting angle is not so large, the fuel does lose a large amount of kinetic energy by this deflection. Therefore, the fuel is readily peeled off from the outermost edge 43 of the entrance opening 41, since a relatively large amount of kinetic energy is left when the fuel reaches the entrance opening 41 of the nozzle holes 4. As a result, a powerful vortex occurs to facilitate the self-excited vibration of the fuel column or film and atomize the fuel into fine particles.

Figure 4:
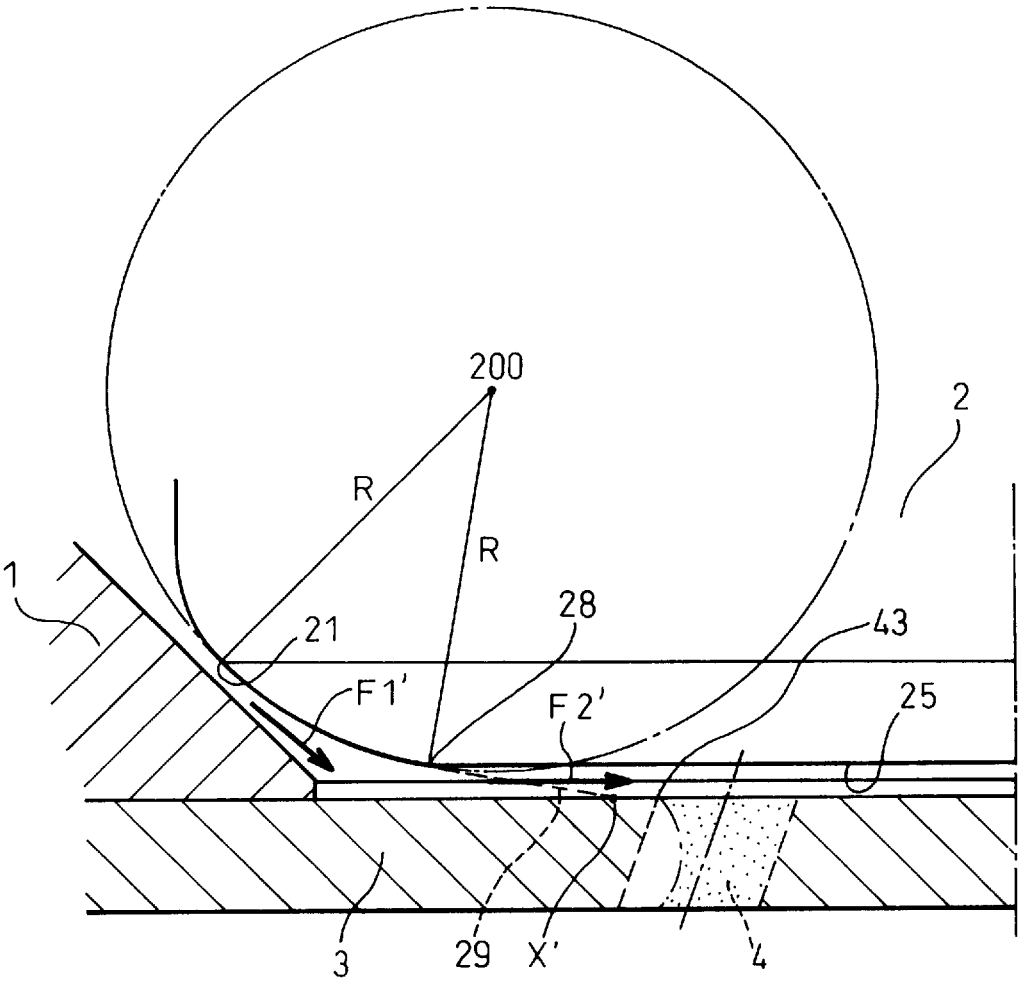
FIG. 4 is a schematic enlarged view of a second embodiment of the present invention.

FIG. 4 illustrates a second embodiment of the present invention, having the same structure as the first embodiment, except that a cross-section of the intermediate surface connecting a sealing portion 21 of a needle valve 2 with a bottom surface 25 thereof is a circle having a center 200 and a radius R, i.e., the intermediate surface is spherical.

A point X', defined by the intersection of a tangent line 29 drawn through point 28, at which the above defined circle intersects the bottom surface 25, and an upper surface 31 of the metering member 3, is positioned on the outer side of the outermost edge 43 of the entrance opening 41 of the nozzle holes 4.

The fuel flows in the arrowed directions F1' and F2', substantially in the same manner as the first embodiment, and a similar result is obtained. Since the fuel flows more smoothly on the downstream side of the sealing portion, a loss of kinetic energy becomes smaller, and, accordingly, the fuel is more smoothly peeled off from the outermost edge of the entrance opening 41 of the nozzle holes 4 to facilitate the fuel atomization.

Also the fuel left in an area downstream of the sealing portion when the needle valve is closed and thereafter sucked into a cylinder by negative inlet pressure is minimized since a dead volume becomes smaller in the closed state of valve, thereby the exact amount of fuel is sucked into the cylinder.

The configuration of the bottom surface 25 of the needle valve 2 in the above embodiments may be variously modified, for example, to a spherical shape or a conical shape or even to a concave shape.

Figure 5:
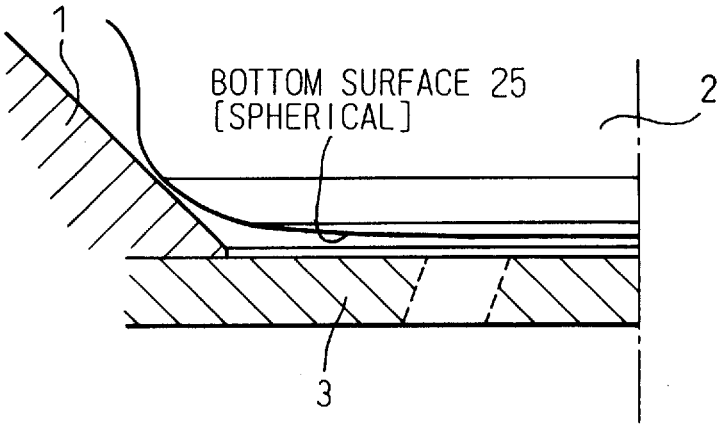
FIG. 5 is a schematic view of a modification of the second embodiment.
Figure 6:
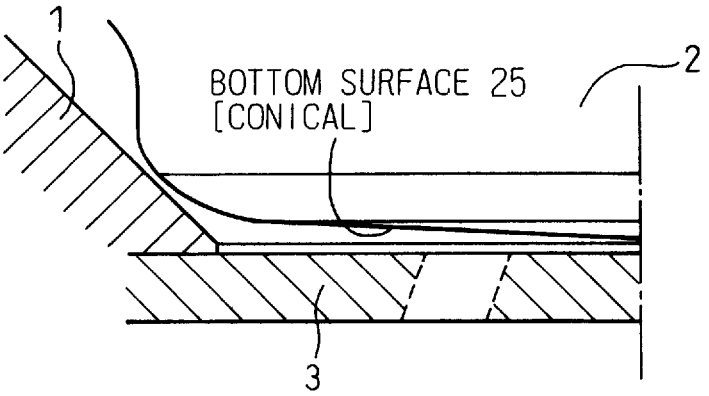
FIG. 6 is a schematic view of another modification of the second embodiment.

FIGS. 5 and 6 illustrate modifications of the second embodiment, wherein the bottom surface 25 of the needle valve 2 is formed as a spherical surface and a conical surface, respectively, so that the dead volume is further reduced to improve the accuracy of fuel injection.

According to the present invention, it is possible to readily peel off the fuel at the entrance opening of the nozzle holes and fuel column or film is well self-excitingly vibrated and a well-atomized fuel is obtained, and, accordingly, improved fuel consumption, increased engine power, and an improved exhaust gas emission can be obtained.

We claim:

1. A fuel injection valve having a valve body, a needle valve accommodated in the valve body for opening and closing a fuel path at a sealing portion, and a metering member provided at a front end of the valve body and having a plurality of nozzle holes for metering fuel and determining the fuel-injecting direction, comprising:

an inner wall of said valve body located downstream of said sealing portion sloping to meet an upstream side surface of said metering member; and an intermediate surface of said needle valve for connecting said sealing portion and a bottom surface of the needle valve with each other forming said fuel path sloped inward in the downstream direction in association with said inner wall for introducing said fuel into said nozzle holes formed in said metering member when said needle valve is in an open state, wherein said intermediate surface of said needle valve being shaped in such a manner that a virtual circle formed by circumscribing intersecting points of a virtual linear extension of a downstream end of said intermediate surface and said upstream side surface of said metering member is positioned outside of a virtual circle circumscribing upstream side openings of said nozzle holes formed in said metering member when the needle valve is in an open state.

2. A fuel injection valve according to claim 1, characterized in that said intermediate surface of said needle valve is conically shaped.

3. A fuel injection valve according to claim 1, characterized in that said intermediate surface of said needle valve is spherically shaped.

* * * * *